US010012428B2

(12) United States Patent
Robroek et al.

(10) Patent No.: US 10,012,428 B2
(45) Date of Patent: Jul. 3, 2018

(54) ACCESS DOOR

(71) Applicant: POLYPLASTIC GROEP B.V., Rotterdam (NL)

(72) Inventors: Monique Elizabeth Francisca Robroek, The Hague (NL); Jan Peter Veeneman, Bergschenhoek (NL)

(73) Assignee: POLYPLASTIC GROEP B.V., Rotterdam (NL)

( * ) Notice: Subject to any disclaimer, the term of this patent is extended or adjusted under 35 U.S.C. 154(b) by 0 days.

(21) Appl. No.: 15/504,417

(22) PCT Filed: Aug. 26, 2015

(86) PCT No.: PCT/NL2015/050595
§ 371 (c)(1),
(2) Date: Feb. 16, 2017

(87) PCT Pub. No.: WO2016/068694
PCT Pub. Date: May 6, 2016

(65) Prior Publication Data

US 2017/0234600 A1 Aug. 17, 2017

(30) Foreign Application Priority Data

Sep. 1, 2014 (NL) ..... 2013398

(51) Int. Cl.
*F25D 23/02* (2006.01)

(52) U.S. Cl.
CPC ..... *F25D 23/02* (2013.01)

(58) Field of Classification Search
CPC ..... F25D 23/02
See application file for complete search history.

(56) References Cited

U.S. PATENT DOCUMENTS 1,329,340 A * 1/1920 Hillman ..... F25D 23/02 52/784.15
1,538,470 A * 5/1925 Copeman ..... F25D 23/02 52/596

(Continued)

FOREIGN PATENT DOCUMENTS

DE 102009003265 A1 11/2010
GB 1042123 A * 9/1966 ..... F25D 23/02

OTHER PUBLICATIONS

Melo Sousa, Filipe, International Search Report, PCT Application No. PCT/NL2015/050595 dated Dec. 7, 2015.

*Primary Examiner* — Jeanette E Chapman
(74) *Attorney, Agent, or Firm* — Perry + Currier Inc.

(57) ABSTRACT

An access door (1) for application in a refrigerated cabinet comprises a multi-walled plastic door construction of a sheet-like first wall (10) and a plane-parallel second wall (20). The walls each comprise all around an edge part (12,22) with which the walls are connected. One of the two walls has a central part (21) which lies offset relative to the edge part (22) and wherein the central part and the edge part are connected by a bridge part (23*a*,23*b*). The door construction has a mounting section (25) for mounting an adjusting member thereon in order to enable adjustment of the door construction in the refrigerated cabinet between a position closing the refrigerated cabinet and an open position. The bridge part (23*a*,23*b*) comprises a primary bridge part section (23*a*) which is adjacent to the mounting section (25) and extends at a first angle from the edge part and a secondary bridge part section (23*b*) which extends at a second angle from the edge part, wherein the second angle is smaller than the first angle.

16 Claims, 2 Drawing Sheets

(56) References Cited

U.S. PATENT DOCUMENTS

| | | | | | |
|---|---|---|---|---|---|
| 2,315,615 | A * | 4/1943 | Guhl | F25D 23/02 | 428/174 |
| 2,977,639 | A * | 4/1961 | Barkhuff, Jr. | B29C 44/16 | 156/245 |
| 3,302,358 | A * | 2/1967 | Jackson | E04B 1/803 | 52/573.1 |
| 3,608,262 | A * | 9/1971 | Smith | B61D 19/00 | 52/524 |
| 3,634,971 | A * | 1/1972 | Kesling | F25D 23/02 | 49/460 |
| 4,644,698 | A * | 2/1987 | Gerdes | F25D 23/082 | 312/296 |
| 5,009,081 | A | 4/1991 | Kruck et al. | | |
| 5,252,408 | A * | 10/1993 | Bridges | E04B 1/803 | 428/621 |
| 5,664,396 | A * | 9/1997 | Lyman | E04B 1/803 | 52/788.1 |
| 6,295,787 | B1 | 10/2001 | Lee | | |
| 8,157,317 | B2 * | 4/2012 | Orii | B62D 25/04 | 296/190.01 |
| 2015/0040599 | A1 * | 2/2015 | Veeneman | F25D 23/02 | 62/246 |

* cited by examiner

ACCESS DOOR

The present invention relates to an access door for a refrigerated cabinet, comprising a multi-walled plastic door construction of an at least substantially sheet-like first wall and an at least substantially plane-parallel second wall, which walls each comprise at least substantially all around an edge part with which the two walls are mutually connected, wherein at least one of the two walls comprises a central part which lies offset relative to the edge part and wherein the central part and the edge part are connected by a bridge part which bounds all around a cavity between the two walls, wherein the door construction has on at least one of its sides a mounting portion for mounting an adjusting member thereon in order to enable adjustment of the door construction therewith in the refrigerated cabinet between a closed position and an open position of the refrigerated cabinet.

Such an access door is usually applied in refrigerated cabinets in shops such as supermarkets, department stores, self-service restaurants, filling stations and local shops. Products such as foods and beverages are stored and displayed in cooled state in the refrigerated cabinets, this for instance in order to keep said products fresh for longer. The refrigerated cabinets are often vertical cabinets in which cooling means are provided for the purpose of cooling to and maintaining at a predetermined temperature a cooling space defined by the cabinet. The cabinet comprises here a freely accessible side along which a member of the shopping public can reach into the cooling space in order to remove one or more desired products therefrom. In order to prevent a large amount of the cooled air escaping from the product space an adjustable access door is usually provided on the freely accessible side of the refrigerated cabinet. The access door forms a separation preventing a free exchange of air between the product space and ambient air. Energy consumption of the refrigerated cabinet is hereby reduced.

Although the access door can be manufactured from glass, it has been found that an embodiment in plastic offers many advantages, particularly in respect of weight, transparency and durability. For an exceptional weight-saving applicant has developed a double-walled plastic access door of the type stated in the preamble which, using less material, provides a corresponding or even greater strength and stiffness relative to single-walled embodiments. This access door is known from the international patent application PCT/NL 2013/050145.

The double-walled plastic access door described therein as applied in a refrigerated cabinet comprises a sheet-like first wall and a substantially plane-parallel second wall attached thereto, which walls each comprise at least substantially all around an edge part with which the two walls are mutually connected. The second wall comprises a central part which lies offset relative to the edge part in order to leave a cavity space to the first wall. The central part and the edge part are connected here by a bridge part which bounds the cavity between the two walls all around. To enable adjustment of the access door between a closed position closing the product space and an open position leaving the product space clear, the access door has on an upper side and opposite lower side a mounting section on which a hinge is mounted. The access door is mounted on the refrigerated cabinet with the hinges so as to realize a rotation of the access door between the closed position and open position.

The known access door provides excellent properties in respect of a desired insulating effect, overall weight, transparency and form-retention or stiffness, and is thus highly suitable for application in a refrigerated cabinet. It has however been found in practice that in determined undesired conditions there is a risk of cracks forming in the access door, particularly in the wall material close to the mounting section where the hinges engage on the access door.

The present invention has for its object to provide an improvement in the access door which reduces the risk of the access door being adversely affected, and in particular breaking.

In order to realize the stated object an access door of the type described in the preamble is characterized according to the present invention in that the bridge part comprises a primary bridge part section which is adjacent to the mounting section and extends at a first angle from the edge part, and that the bridge part comprises a secondary bridge part section which extends at a second angle from the edge part, wherein the second angle is smaller than the first angle.

The invention is based here on the insight that an angle of the bridge part relative to the edge part influences the properties of the associated wall in respect of a stiffness and strength thereof. A bridge part which extends at least substantially perpendicularly, so at an angle of 90 degrees, from the edge part provides the greatest possible support here so that the access door has a high stiffness and so is not likely to deform. Such a relatively acute angle does however result in certain stresses in the material of the associated wall. In the case of too great an external load on the associated wall, this stress can increase and adversely affect the material and, in an extreme case, result in breakage. At an angle greater than 90 degrees the stress in the wall decreases, but the resulting wall also imparts less stiffness to the access door.

It has been found in practice that in most cases a relatively high external load is exerted on the access door by the hinge or the hinges provided on the access door, for instance because of an incorrect arrangement of the door against the refrigerated cabinet. By making use according to the present invention of a bridge part having a primary section, which is adjacent to the mounting section on which the hinge is mounted, and having a secondary section a stress in the material specifically close to the mounting section can be reduced by having the bridge part extend from the edge part in the primary section at a relatively large angle greater than 90 degrees, while the greatest possible stiffness of the wall can be maintained by having the bridge part extend from the edge part in the secondary section at a relatively small angle at or in the vicinity of about 90 degrees. The access door thus retains a stiffness which is more than acceptable while the chance of deterioration close to the hinge or the hinges is considerably reduced.

In a preferred embodiment the access door according to the present invention is characterized in that the edge parts of the walls form a first length side, an opposite second length side, a first width side and an opposite second width side of the door construction, that at least one of the first and second width sides of the door construction comprises the mounting section and that the primary bridge part section of the bridge part extends along at least substantially the whole width side of the door construction. Although a primary bridge part section located only adjacently of the mounting section for the adjusting member also works well, the wall with such a primary bridge part section extending over a full width of the wall can be manufactured a good deal more easily and at lower cost price.

When the access door has on two opposite sides a mounting section for receiving two adjusting members thereon, a further preferred embodiment of the access door according to the present invention is then characterized in that the primary bridge part section of the bridge part extends at least substantially wholly along each side of the door construction having a mounting section for an adjusting member.

A further preferred embodiment of the access door according to the present invention has the feature that the secondary bridge part section of the bridge part extends along at least substantially the whole length side of the door construction. The length side of the access door is in most cases the longer side of the access door so that the secondary bridge part section imparting a stiffness and strength to the door construction forms a greatest part of the bridge part.

In a particular embodiment the access door according to the present invention is characterized in that the first angle lies between 110 and 165 degrees and that the second angle lies between 100 and 125 degrees. Although the invention is based mainly on the fact that a difference in angle of the primary bridge part section located at the mounting section for an adjusting member relative to the secondary bridge part section results in a door construction which is less likely to break, these specific embodiments do however provide very good results in respect of both stiffness and strength of the access door as a resistance to deterioration or breakage in or close to the mounting sections for mounting of an adjusting member such as a hinge.

The angle made by the bridge part sections relative to the base part of the second wall is less important than the angle between the bridge part sections and the edge part of the second wall since it lies further away from the mounting section on which the adjusting member is mounted, and so an external load will act less thereon. In some cases, and certainly embodiments wherein the angle between the primary bridge part section and the edge part is relatively great, this angle can nevertheless begin to form a weakest point in the door construction. In a further preferred embodiment according to the present invention the access door therefore has the feature that the primary bridge part section extends from the base part at a first further angle and that the secondary bridge part section extends from the base part at a second further angle, wherein the first further angle is greater than the second further angle. A possible stress in the second wall in a transition zone between the base part and the primary bridge part section is hereby reduced.

A further preferred embodiment of the access door according to the present invention has the feature that the first angle and first further angle are at least substantially equal and that the second angle and second further angle are at least substantially equal. A possible stress in the second wall in a transition zone between the edge part and the bridge part and a transition zone between the base part and the bridge part is hereby approximately equal so that a force exerted on the door construction is distributed uniformly over substantially the whole of the second wall.

In a particular embodiment the access door according to the present invention is characterized in that the bridge part extends at least substantially linearly between the edge part and the base part. Because the bridge part is thus linear or straight, there are no deformations, and so no weak spots, in the bridge part itself.

Although a transition from the primary bridge part section to the secondary bridge part section can be direct, the access door according to the present invention is characterized in a further preferred embodiment in that the bridge part between the primary bridge part section and the secondary bridge part section comprises an intermediate bridge part section, an angle of which relative to the edge part changes gradually along the length of the intermediate bridge part section from the first angle on a side adjacent to the primary bridge part section to the second angle on a side adjacent to the secondary bridge part section. Such a gradual progression in the bridge part prevents an abrupt change in angle between the different bridge part sections that could result in a weak point in the second wall.

A further particular embodiment of the access door according to the present invention has the feature that at least one of the walls is manufactured at least substantially from plastic, in particular a plastic chosen from a group of polymethyl methacrylate (PMMA), polycarbonate (PC) and polyethylene terephthalate glycol (PETG). These plastics have a high transparency so that an access door manufactured therefrom provides a substantially unimpeded and clear view of products arranged therebehind.

The invention will now be further elucidated with reference to an exemplary embodiment and an associated drawing. In the drawing.

The figures are purely schematic here and not drawn to scale. Some parts and dimensions in particular may be exaggerated to greater or lesser extent for the sake of clarity.

Figure 1A:
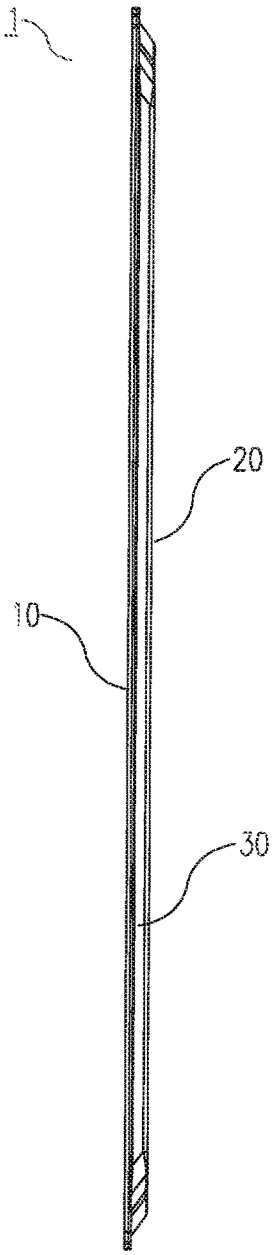
FIG. 1A is a side view of an exemplary embodiment of an access door according to the present invention.
Figure 1B:
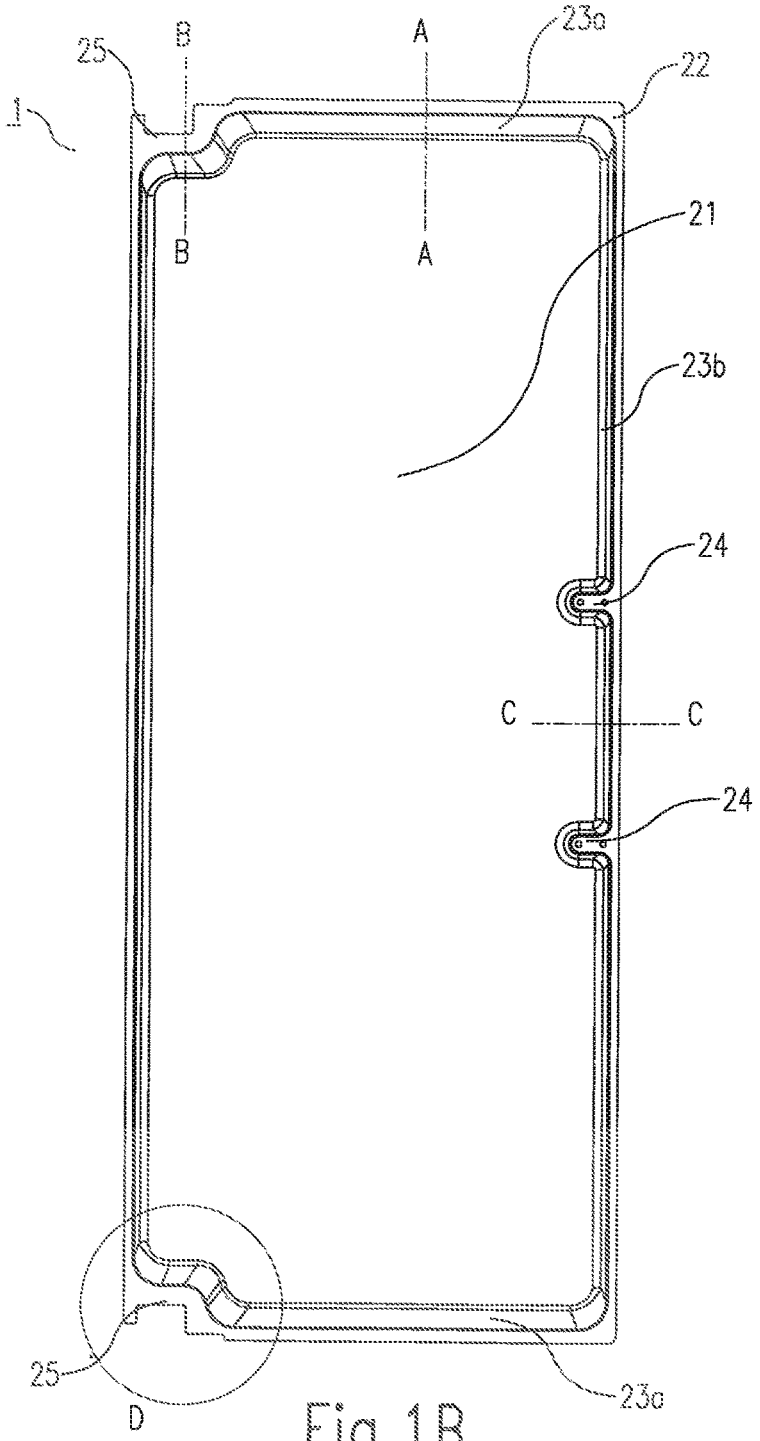
FIG. 1B is a front view of the exemplary embodiment of an access door according to the present invention.
Figure 2A:
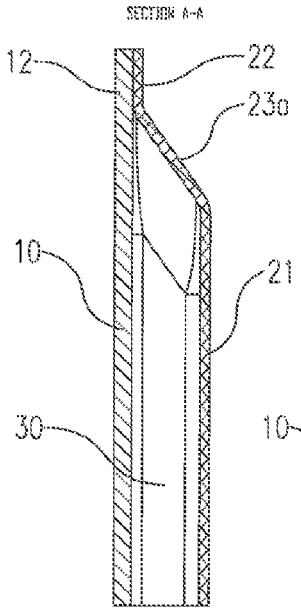
FIG. 2A is a detail view of a longitudinal section of the access door shown in FIG. 1B along line A-A.
Figure 2B:
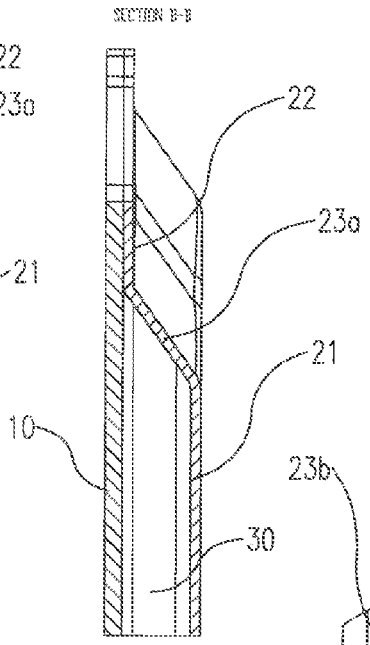
FIG. 2B is a detail view of a longitudinal section of the access door shown in FIG. 1B along line B-B.
Figure 2C:
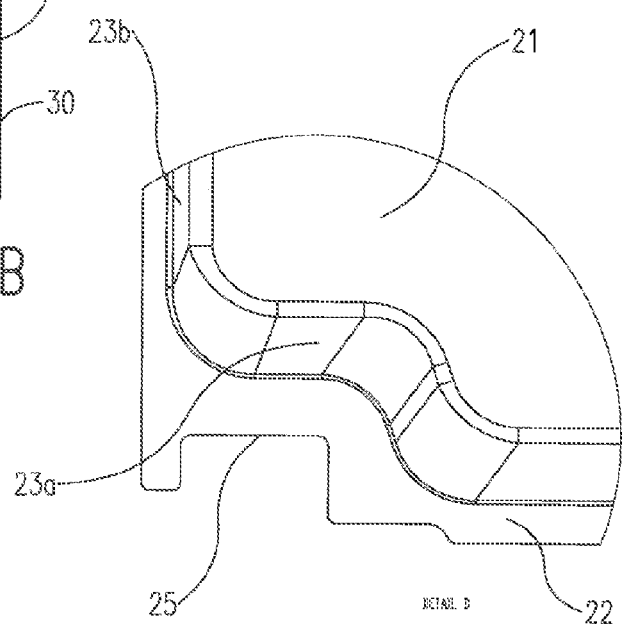
FIG. 2C is a detail view of the circled part D of the access door shown in FIG. 1B.
Figure 2D:
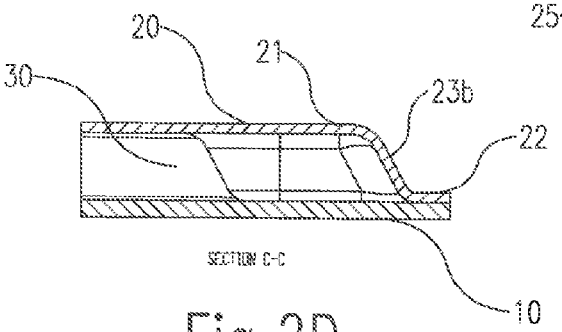
FIG. 2D is a detail view of a cross-section of the access door shown in FIG. 1B along line B-B.

As shown in FIGS. 1A, 1B, access door (1) according to the present invention comprises a door construction with a sheet-like first wall (10) and an at least substantially plane-parallel second wall (20). Walls (10, 20) are both manufactured here from moulded polymethyl methacrylate so that the resulting door construction has a high transparency. First wall (10) is substantially a wholly flat sheet, while second wall (20) is manufactured from a flat sheet by means of a mould. Second sheet (20) comprises here a base part (21) which lies offset relative to an edge part (22) with which second wall (20) is attached against an edge part (12) of first wall (10) so as to form the multi-walled door construction. The attachment between the edge parts of walls (10, 20) is realized by applying a suitable transparent acrylate adhesive therebetween.

Base part (21) and edge part (22) of second wall (20) are connected by an at least substantially linear bridge part (23), whereby second wall (20) has a certain shallow tray shape. Such a tray shape imparts stiffness and strength to the door construction so that, when applied in a refrigerated cabinet, it will not deform and also leaves a cavity space (30) relative to the first wall in the door construction for a good insulating action of the access door.

The access door has two mutually opposite length sides which define a height of the access door, and two mutually opposite width sides which form respectively an upper side and underside of the access door. A rear side of the access door facing toward the product space can comprise the first wall and, in an alternative embodiment, comprise the second wall. Provided on one of the length sides is a grip provision for the access door. In this exemplary embodiment the grip provision comprises two recesses (24) in which a grip member such as a door handle can be arranged and connected to the access door in order to enable easy manual opening and closing of the access door relative to the refrigerated cabinet in which it is applied.

Close to the opposite length side the access door has on both width sides a mounting section (25) for mounting of an adjusting member such as a hinge. The design of the second sheet is adapted hereto in the sense that the bridge part and base part provide space therefor.

As shown in more detail in FIGS. 2A to 2D, bridge part (23) in second wall (20) has at least a primary bridge part section (23*a*) and a secondary bridge part section (23*b*). The primary bridge part section (23*a*) is adjacent to mounting sections (25) and extends along the whole width sides of the access door. The secondary bridge part section (23*b*) extends along the length sides of the access door. The primary bridge part section (23*a*) extends from edge part (22) at a first angle of between 110 and 165 degrees, while the secondary bridge part section (23*b*) extends from edge part (22) at a second angle of between 100 and 125 degrees, wherein the second angle is smaller than the first angle. The secondary bridge part section which forms a greatest part of the bridge part on the length sides imparts a good stiffness and strength to the door construction due to the relatively small angle which it describes relative to the edge part. The primary bridge part section adjacent to the mounting section, which in practice can be considerably loaded by an adjusting member provided thereon, has a better resistance to such a load due to the relatively greater angle in relation to the edge part, whereby the access door is less likely to be adversely affected or to break close to the adjusting member.

Although the invention has been further elucidated on the basis of only a single exemplary embodiment, it will be apparent that the invention is by no means limited thereto. On the contrary many variations and embodiments are still possible within the scope of the invention for a person with ordinary skill in the art.

The invention claimed is:

1. Access door for a refrigerated cabinet, comprising a multi-walled plastic door construction of an at least substantially sheet-like first wall and an at least substantially plane-parallel second wall, wherein said first wall comprises a first edge portion that extends at least substantially all along a periphery of said first wall, wherein said second wall comprises a second edge portion that extends at least substantially all along a periphery of said second wall, wherein said first edge portion and second edge portion are connected to one another to mutually connect said first wall and said second wall, wherein at least one of said first wall and said second wall comprises a central portion that lies offset relative to the edge portion of said wall and forming a cavity between said first wall and said second wall, wherein said central portion and the edge portion are connected by a bridge portion that extends all around said cavity between said walls, wherein the door construction has on at least one of its sides a mounting section for mounting an adjusting member thereon in order to enable adjustment of the door construction therewith in the refrigerated cabinet between a position closing the refrigerated cabinet and an open position, wherein the bridge portion comprises a primary bridge part section which is adjacent to the mounting section and extends at a first angle from the edge portion, and wherein the bridge portion comprises a secondary bridge part section which extends at a second angle from the edge portion, and wherein the second angle is smaller than the first angle.

2. Access door as claimed in claim 1, characterized in that the edge portions of the walls form a first length side, an opposite second length side, a first width side and an opposite second width side of the door construction, that at least one of the first and second width sides of the door construction comprises the mounting section and that the primary bridge part section of the bridge portion extends along at least substantially the whole width side of the door construction.

3. Access door as claimed in claim 1, characterized in that the secondary bridge part section of the bridge portion extends along at least substantially the whole length side of the door construction.

4. Access door as claimed in claim 1, characterized in that the first angle lies between 110 and 165 degrees and that the second angle lies between 100 and 125 degrees.

5. Access door as claimed in claim 1, characterized in that the primary bridge part section extends from the central portion at a first further angle and that the secondary bridge part section extends from the central portion at a second further angle, wherein the first further angle is greater than the second further angle.

6. Access door as claimed in claim 1, characterized in that the bridge portion extends at least substantially linearly between the edge portion and the central portion.

7. Access door as claimed in claim 1, characterized in that at least one of the walls is manufactured at least substantially from plastic, in particular a plastic chosen from a group of polymethyl methacrylate (PMMA), polycarbonate (PC) and polyethylene terephthalate glycol (PETG).

8. Access door as claimed in claim 2, characterized in that the secondary bridge part section of the bridge portion extends along at least substantially the whole length side of the door construction.

9. Access door as claimed in claim 2, characterized in that the first angle lies between 110 and 165 degrees and that the second angle lies between 100 and 125 degrees.

10. Access door as claimed in claim 3, characterized in that the first angle lies between 110 and 165 degrees and that the second angle lies between 100 and 125 degrees.

11. Access door as claimed in claim 2, characterized in that the primary bridge part section extends from the central portion at a first further angle and that the secondary bridge part section extends from the central portion at a second further angle, wherein the first further angle is greater than the second further angle.

12. Access door as claimed in claim 3, characterized in that the primary bridge part section extends from the central portion at a first further angle and that the secondary bridge part section extends from the central portion at a second further angle, wherein the first further angle is greater than the second further angle.

13. Access door as claimed in claim 2, characterized in that the primary bridge part section extends at least substantially linearly between the edge portion and the central portion.

14. Access door as claimed in claim 3, characterized in that the bridge portion extends at least substantially linearly between the edge portion and the central portion.

15. Access door as claimed in claim 2, characterized in that at least one of the walls is manufactured at least substantially from plastic, in particular a plastic chosen from a group of polymethyl methacrylate (PMMA), polycarbonate (PC) and polyethylene terephthalate glycol (PETG).

16. Access door as claimed in claim 3, characterized in that at least one of the walls is manufactured at least substantially from plastic, in particular a plastic chosen from a group of polymethyl methacrylate (PMMA), polycarbonate (PC) and polyethylene terephthalate glycol (PETG).

* * * * *